US008378572B2

(12) United States Patent
Oida et al.

(10) Patent No.: US 8,378,572 B2
(45) Date of Patent: Feb. 19, 2013

(54) PLASMA DISPLAY PANEL AND METHOD FOR MANUFACTURING THE SAME

(75) Inventors: Osamu Oida, Osaka (JP); Akifumi Okigawa, Osaka (JP); Noriteru Maeda, Osaka (JP)

(73) Assignee: Panasonic Corporation, Osaka (JP)

( * ) Notice: Subject to any disclaimer, the term of this patent is extended or adjusted under 35 U.S.C. 154(b) by 58 days.

(21) Appl. No.: 13/145,193

(22) PCT Filed: Feb. 21, 2011

(86) PCT No.: PCT/JP2011/000941

§ 371 (c)(1), (2), (4) Date: Jul. 19, 2011

(87) PCT Pub. No.: WO2011/105036

PCT Pub. Date: Sep. 1, 2011

(65) Prior Publication Data

US 2011/0273087 A1 Nov. 10, 2011

(30) Foreign Application Priority Data

Feb. 25, 2010 (JP) ..... 2010-0039703

(51) Int. Cl.
*H01J 17/18* (2012.01)

(52) U.S. Cl. ..... 313/587; 313/586

(58) Field of Classification Search ..... 313/582–587; 445/23–25

See application file for complete search history.

(56) References Cited

U.S. PATENT DOCUMENTS

| | | | | |
|---|---|---|---|---|
| 3,858,284 | A * | 1/1975 | Costa et al. | 445/25 |
| 5,754,003 | A | 5/1998 | Murai et al. | |
| 7,298,085 | B2 * | 11/2007 | Kwon et al. | 313/582 |
| 2002/0024303 | A1 | 2/2002 | Sano et al. | |
| 2004/0256990 | A1 * | 12/2004 | Fujitani | 313/586 |
| 2006/0033436 | A1 | 2/2006 | Sano et al. | |
| 2008/0084161 | A1 | 4/2008 | Sano et al. | |
| 2008/0203915 | A1 * | 8/2008 | Lee et al. | 313/586 |
| 2009/0121631 | A1 | 5/2009 | Sawa et al. | |

FOREIGN PATENT DOCUMENTS

| | | |
|---|---|---|
| JP | 8-185802 | 7/1996 |
| JP | 11-204040 | 7/1999 |
| JP | 2001-312971 | 11/2001 |
| JP | 2002-42661 | 2/2002 |
| WO | 2007/023564 | 3/2007 |

OTHER PUBLICATIONS

International Search Report issued Apr. 12, 2011 in International (PCT) Application No. PCT/JP2011/000941.

Written Opinion of the International Searching Authority issued Apr. 12, 2011 in International (PCT) Application No. PCT/JP2011/000941.

* cited by examiner

*Primary Examiner* — Anh Mai
*Assistant Examiner* — Fatima Farokhrooz
(74) *Attorney, Agent, or Firm* — Wenderoth, Lind & Ponack, L.L.P.

(57) ABSTRACT

A plasma display panel includes: a front plate; a rear plate having barrier ribs; a sealing member that seals a peripheral edge of the front plate and a peripheral edge of the rear plate; and a bonding layer that bonds at least part of the barrier ribs and the front plate to each other. The sealing member has a first glass member. The bonding layer has a second glass member. A deformation point of the second glass member is lower than a softening point of the first glass member. A softening point of the second glass member is higher than the softening point of the first glass member.

6 Claims, 6 Drawing Sheets

PLASMA DISPLAY PANEL AND METHOD FOR MANUFACTURING THE SAME

This Application is a U.S. National Phase Application of PCT International Application PCT/JP2011/000941.

BACKGROUND OF THE INVENTION

I. Technical Field

A technique disclosed here relates to a plasma display panel for use in a display device and the like, and a method for manufacturing the same.

II. Description of the Related Art

A discharge space formed inside a plasma display panel (hereinafter, referred to as a PDP) is partitioned by barrier ribs formed in a rear plate. Further, there is known a technique for bonding the upper end of the barrier rib and the front plate to each other (e.g., refer to Unexamined Japanese Patent Publication No. H11-204040).

SUMMARY OF THE INVENTION

A PDP includes: a front plate; a rear plate having barrier ribs; a sealing member that seals a peripheral edge of the front plate and a peripheral edge of the rear plate; and a bonding layer that bonds at least part of the barrier ribs and the front plate to each other. The sealing member has a first glass member. The bonding layer has a second glass member. A deformation point of the second glass member is lower than a softening point of the first glass member. A softening point of the second glass member is higher than the softening point of the first glass.

There is provided a method for manufacturing a PDP that includes: a front plate; a rear plate having barrier ribs; a sealing member that seals a peripheral edge of the front plate and a peripheral edge of the rear plate; and a bonding layer that bonds at least part of the barrier ribs and the front plate to each other. The sealing member has a first glass member, and the bonding layer has a second glass member having a deformation point lower than a softening point of the first glass member, and a softening point higher than the softening point of the first glass member. Thermal treatment is performed at a temperature higher than the softening point of the first glass member and lower than the softening point of the second glass member, thereby to seal the front plate and the rear plate, and at least part of the barrier ribs and the front plate are bonded to each other.

DETAILED DESCRIPTION OF THE INVENTION

1. Configuration of PDP 1

Figure 1:
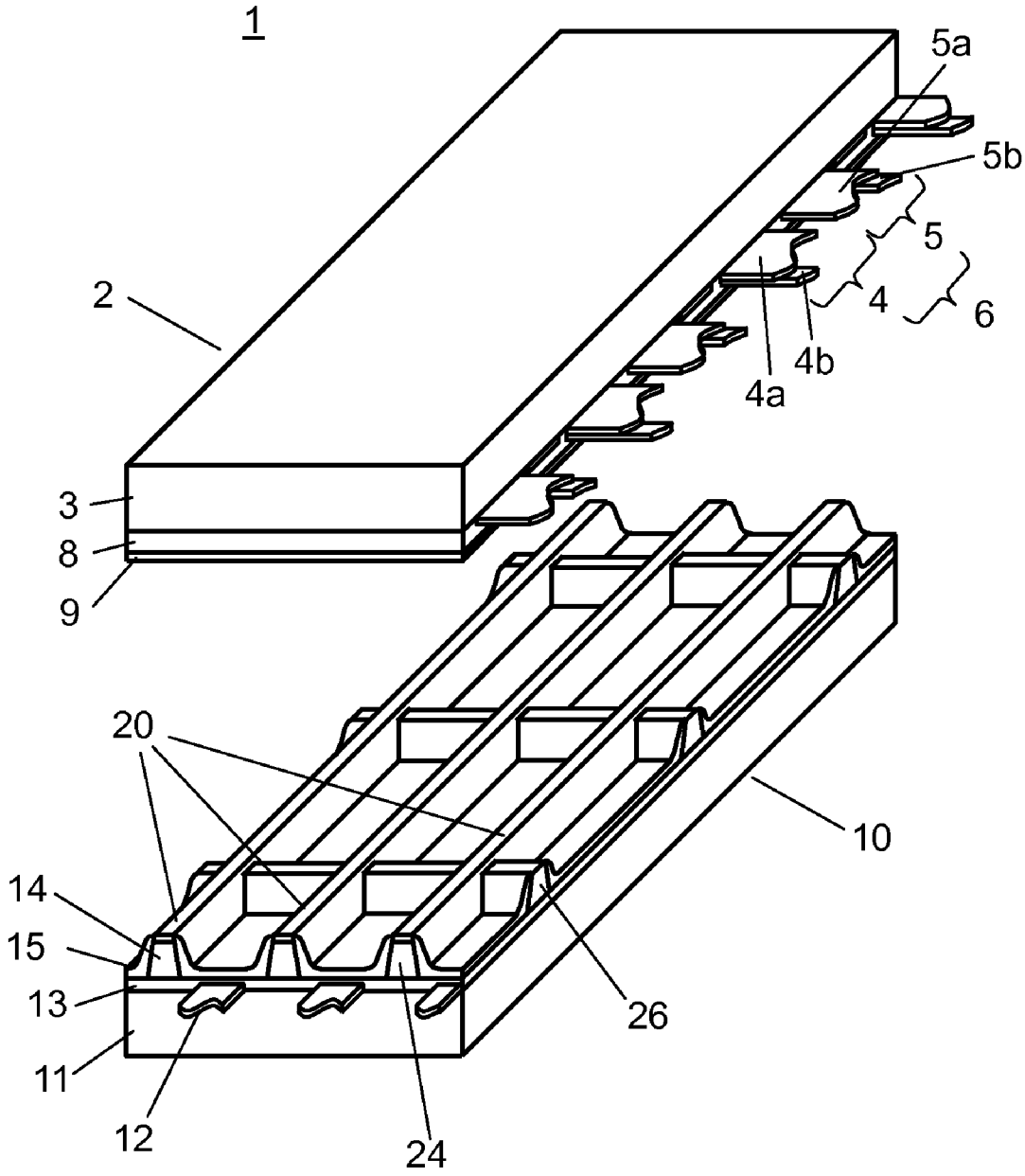
FIG. 1 is an exploded perspective view of a PDP according to an embodiment.
Figure 2:
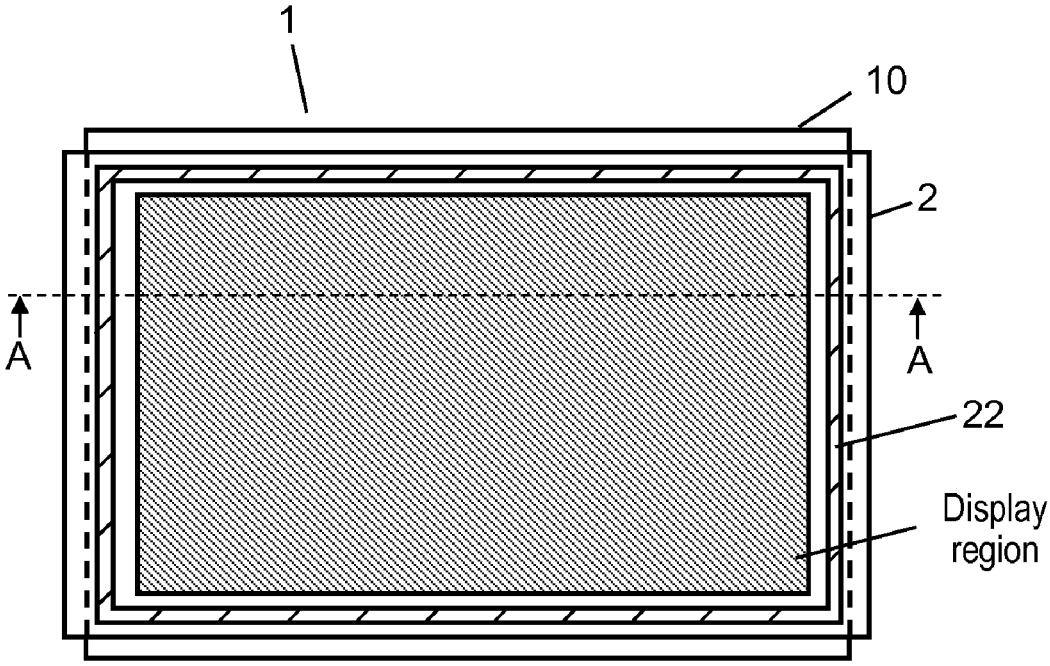
FIG. 2 is a front view of the PDP according to the embodiment, seen from the front plate side.
Figure 3:
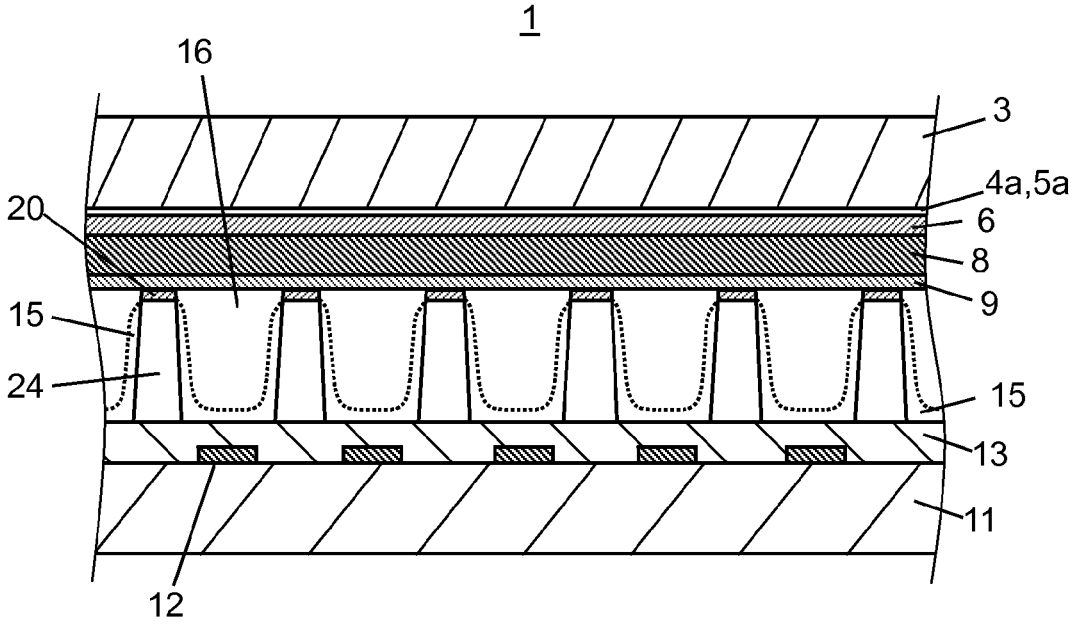
FIG. 3 is a view showing part of a cross section A-A in FIG. 2.

PDP 1 according to the present embodiment is an AC surface discharge type PDP. As shown in FIGS. 1, 2 and 3, in PDP 1, front plate 2 is made up of front glass substrate 3 and the like and rear plate 10 is made up of rear glass substrate 11 and the like, and are arranged so as to be opposed to each other. On front glass substrate 3, plural band-like display electrodes 6 made up of scan electrodes 4 and sustain electrodes 5 are arranged. Scan electrode 4 is made up of transparent electrode 4*a*, and bus electrode 4*b* superimposed on transparent electrode 4*a*. Sustain electrode 5 is made up of transparent electrode 5*a*, and bus electrode 5*b* superimposed on transparent electrode 5*a*. Further, on front glass substrate 3, dielectric layer 8 that coats display electrode 6 is formed. Dielectric layer 8 functions as a capacitor. Further, on the surface of dielectric layer 8, protective layer 9 made of magnesium oxide (MgO) or the like is formed.

On rear glass substrate 11, plural band-like address electrodes 12 are arranged in parallel with one another in a direction orthogonal to display electrodes 6. Moreover, base dielectric layer 13 that coats address electrodes 12 is formed. Further, on base dielectric layers 13 formed among address electrodes 12, barrier ribs 14 having a predetermined height and partitioning discharge space 16 are formed. Among barrier ribs 14, phosphor layer 15 that emits red-color light, phosphor layer 15 that emits blue-color light and phosphor layer 15 that emits green-color light are sequentially formed, each layer emitting light by ultraviolet rays. Further, front plate 2 and rear plate 10 are bonded to each other by bonding layer 20.

It is to be noted that a detail of bonding layer 20 will be described later.

As shown in FIG. 2, PDP 1 includes sealing member 22 that seals a peripheral edge of front plate 2 and a peripheral edge of rear plate 10. Sealing member 22 bonds front plate 2 and rear plate 10 to each other. That is, PDP 1 is air-tight sealed by sealing member 22 including the first glass member. Further, a region where sealing member 22 is arranged is outside a display region.

As first glass member, as an example, there is used a glass frit mainly composed of bismuth trioxide ($Bi_2O_3$), diboron trioxide ($B_2O_3$), vanadium pentoxide ($V_2O_5$) or the like. For example, $Bi_2O_3$—$B_2O_3$—RO-MO based glass is used. Herein, R is any of barium (Ba), strontium (Sr), calcium (Ca) and magnesium (Mg). M is any of copper (Cu), antimony (Sb) and iron (Fe). Other than the above, for example, $V_2O_5$—BaO—TeO—WO based glass is used. Moreover, as sealing member 22, there can be used one obtained by adding a filler made of oxide, such as aluminum oxide ($Al_2O_3$), silicon dioxide ($SiO_2$) or cordierite, to the first glass member. A softening point of the first glass member is on the order of 460° C. to 480° C.

Further, discharge gas containing xenon (Xe) is filled into discharge space 16 with a pressure of 55 kPa to 80 kPa.

2. Detail of Bonding Layer 20

In recent years, a glass substrate with a smaller plate thickness has come to be used for front glass substrate 3 and rear glass substrate 11 for the purpose of reduction in weight of PDP 1. Moreover, with increasing definition of PDP 1, a width of barrier rib 14 is getting smaller. Mechanical strength of PDP 1 depends on strength of the glass substrate itself and strength of a joint portion between front plate 2 and rear plate 10. The joint portion is a region where barrier rib 14 and front plate 2 are joined with a region arranged with sealing member 22. That is, in order to achieve reduced weight and increased definition of PDP 1, it is of importance to suppress a decrease in mechanical strength of PDP 1.

As shown in FIGS. 1, 2 and 3, PDP 1, in the present embodiment, has barrier ribs 14 that partition discharge space 16, and bonding layer 20 that bonds at least part of barrier ribs 14 and front plate 2 to each other. Moreover, in the present embodiment, sealing member 22 includes a first glass member. Bonding layer 20 includes a second glass member. A deformation point of the second glass member is lower than a softening point of the first glass member. A softening point of the second glass member is higher than the softening point of the first glass member. According to the above configuration, it is possible to set a later-mentioned thermal treatment temperature (hereinafter referred to as a sealing temperature) at the time of sealing to a range higher than the softening point of the first glass member and lower than softening point of the second glass member.

Further, in the present embodiment, front plate 2 has band-like display electrodes 6, as shown in FIG. 1. Moreover, barrier ribs 14 include first barrier ribs 24 arranged in a direction intersecting with display electrodes 6 and second barrier ribs 26 orthogonal to first barrier ribs 24. Bonding layer 20 may be provided on the top of first barrier rib 24.

2-1. Composition of Bonding Layer 20

As the second glass member included in bonding layer 20, a glass frit containing $Bi_2O_3$ and $B_2O_3$ is preferred. $Bi_2O_3$ increases a thermal expansion coefficient, and lowers a softening point. That is, it has a function to enhance bonding force. $B_2O_3$ forms a glass framework. Further, $B_2O_3$ lowers a thermal expansion coefficient, and raises a softening point. As the glass frit, for example, $Bi_2O_3$—$B_2O_3$—ZnO—$SiO_2$—RO based glass is used. Herein, R is any of Ba, Sr, Ca and Mg.

Further, a molar ratio of $Bi_2O_3$ to $B_2O_3$ in the second glass member is preferably not less than 0.25:1 and not more than 4:1. Within this range, favorable bonding force is obtained. Further, the molar ratio of $Bi_2O_3$ to $B_2O_3$ in the second glass member is more preferably not less than 0.5:1 and not more than 2:1. Within this range, more favorable bonding force is obtained.

Moreover, the second glass member more preferably contains not less than 10 mol % and not more than 40 mol % of $Bi_2O_3$, and not less than 10 mol % and not more than 40 mol % of $B_2O_3$. When $Bi_2O_3$ is less than 10 mol %, the bonding force decreases. On the other hand, when $Bi_2O_3$ exceeds 40 mol %, crystallization of the second glass member begins at the time of the sealing. That is, the bonding force decreases. Furthermore, the second glass member more preferably contains not less than 20 mol % and not more than 40 mol % of $Bi_2O_3$, and not less than 20 mol % and not more than 40 mol % of $B_2O_3$.

The deformation point of the second glass member described above is in the range of 425° C. to 455° C. Further, the softening point of the second glass member is in the range of 500° C. to 530° C.

It is to be noted that the softening point is a temperature at which glass significantly begins to be softened and transformed under its own weight. In other words, the softening point is a temperature at which glass comes to have a viscosity of approximately $10^{7.6}$ dPa·s.

The deformation point can be calculated by thermo-mechanical analysis. The thermo-mechanical analysis is a method for changing a temperature of a sample based on a certain program, while applying a non-oscillatory load such as compression, pulling or distortion, to measure transformation of the material as a function of the temperature or the time. As a thermo-mechanical analyzer, there can for example be used TMA-60, manufactured by Shimadzu Corporation.

The deformation point is a temperature at which expansion apparently stops in terms of a thermal expansion curve indicating changes in temperature and volume of glass according to the thermo-mechanical analysis. That is, with a jig intruded into the glass itself due to a measurement mechanism of the thermo-mechanical analysis, the thermal expansion coefficient of the glass sharply decreases. In other words, the deformation point is a temperature at which glass comes to have a viscosity of $10^{10}$ to $10^{11}$ dPa·s.

3. Method for Manufacturing PDP 1

Figure 4:
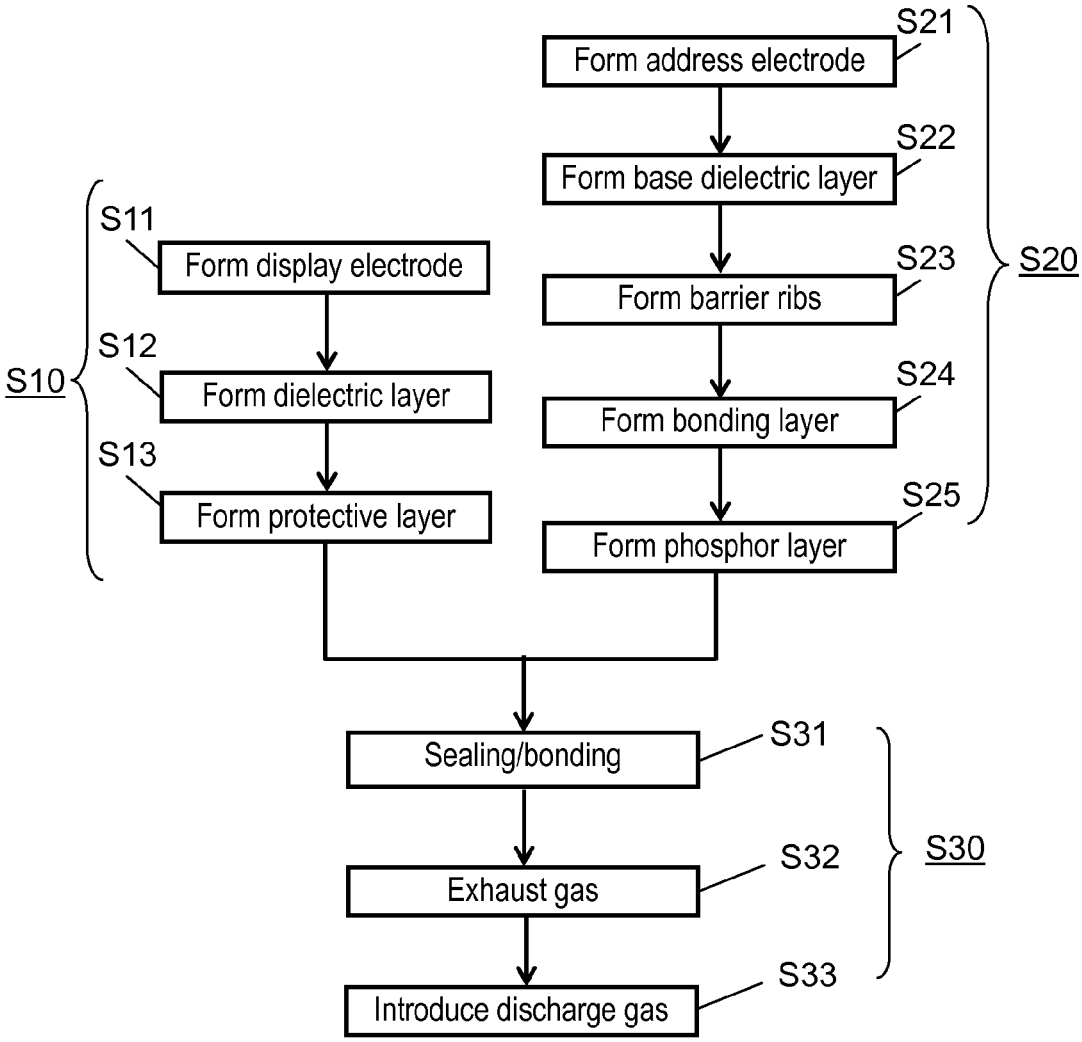
FIG. 4 is a manufacturing flow diagram of the PDP according to the embodiment.

As shown in FIG. 4, a method for manufacturing PDP 1 is broadly divided into a step (S10) of forming front plate 2, a step (S20) of forming rear plate 10, and a step (S30) of assembling front plate 2 and rear plate 10. S10 includes a step (S11) of forming display electrodes 6, a step (S12) of forming dielectric layer 8, and a step (S13) of forming protective layer 9. S20 includes a step (S21) of forming address electrodes 12, a step (S22) of forming base dielectric layer 13, a step (S23) of forming barrier ribs 14, a step (S24) of forming bonding layer 20, and a step (S25) of forming phosphor layers 15. Further, S30 includes a step (S31) of performing sealing and bonding, a step (S32) of exhausting gas, and a step (S33) of introducing discharge gas.

3-1. Manufacturing of Front Plate 2

3-1-1. Formation of Display Electrode 6

In S11, scan electrodes 4 and sustain electrodes 5 are formed on front glass substrate 3 by photolithography. First, transparent electrodes 4*a*, 5*a* made of indium tin oxide (ITO) or the like are formed.

Next, bus electrodes 4*b*, 5*b* are formed. As a material for bus electrodes 4*b*, 5*b*, there is used an electrode paste containing silver (Ag), a glass frit for binding silver, a photosensitive resin, a solvent and the like. First, by screen printing or the like, the electrode paste is applied to front glass substrate 3 formed with transparent electrodes 4*a*, 5*a*. Next, the solvent in the electrode paste is removed by a baking oven. Subsequently, the electrode paste is exposed via a photomask with a predetermined pattern.

Next, the electrode paste is developed, to form a bus electrode pattern. Finally, the bus electrode pattern is baked by a baking oven at a predetermined temperature. That is, the photosensitive resin in the electrode pattern is removed. Further, the glass frit in the electrode pattern is melted. The glass frit having been melted is re-vitrified after the baking. Bus electrodes 4*b*, 5*b* are formed by the above process.

Herein, other than the method for screen-printing the electrode paste the electrode paste, sputtering, vapor deposition, or the like can be employed.

3-1-2. Formation of Dielectric Layer 8

Next, in S12, dielectric layer 8 is formed. As a material for dielectric layer 8, there is used a dielectric paste containing a dielectric glass frit, a resin, a solvent and the like. First, by die coating or the like, the dielectric paste coats scan electrodes 4 and sustain electrodes 5, to be applied with a predetermined thickness onto front glass substrate 3. Next, the solvent in the dielectric paste is removed by the baking oven. Finally, the dielectric paste is baked by the baking oven at a predetermined temperature. That is, the resin in the dielectric paste is removed. Further, the dielectric glass frit is melted. The dielectric glass frit having been melted is re-vitrified after the baking. Dielectric layer 8 is formed by the above process. Herein, other than the method for die-coating the dielectric paste, screen printing, spin coating or the like can be employed. Further, a film to be dielectric layer 8 can be formed by CVD (Chemical Vapor Deposition) or the like without using the dielectric paste.

3-1-3. Formation of Protective Layer 9

Next, in S13, protective layer 9 made of magnesium oxide (MgO) or the like is formed on dielectric layer 8. Protective layer 9 is formed using, as an example, an EB (Electron Beam) vapor deposition apparatus. A material for protective layer 9 is a pellet made of single-crystal MgO. The pellet may further be added with aluminum (Al), silicon (Si) or the like as impurities.

First, electron beams are applied to the pellet arranged in a film formation chamber of the EB vapor deposition apparatus. The pellet having received energy of the electron beams is evaporated. The evaporated MgO adheres onto dielectric layer 8 arranged inside the film formation chamber. The film thickness of MgO is adjusted so as to be within a predetermined range by means of intensity of the electron beams, pressure of the film formation chamber, or the like.

It is to be noted that as protective layer 9, other than MgO, there can be used a mixed film with CaO or a film containing a metal oxide such as SrO, BaO or $Al_2O_3$. Further, there can also be used a film containing plural kinds of metal oxides.

Front plate 2 having a predetermined configuration is completed on front glass substrate 3 by the above process.

3-2. Manufacturing of Rear Plate 10

3-2-1. Formation of Address Electrode 12

In S21, address electrodes 12 are formed on rear glass substrate 11 by photolithography. As a material for address electrode 12, there is used an address electrode paste containing silver (Ag) for ensuring conductivity, a glass frit for binding silver, a photosensitive resin, a solvent and the like. First, by screen printing or the like, the address electrode paste is applied with a predetermined thickness onto rear glass substrate 11. Next, the solvent in the address electrode paste is removed by the baking oven. Subsequently, the address electrode paste is exposed via a photomask with a predetermined pattern. Next, the address electrode paste is developed, to form an address electrode pattern. Finally, the address electrode pattern is baked by the baking oven at a predetermined temperature. That is, the photosensitive resin in the address electrode pattern is removed. Further, the glass frit in the address electrode pattern is melted. The glass frit having been melted is re-vitrified after the baking. Address electrode 12 is formed by the above process. Herein, other than the method for screen-printing the address electrode paste, sputtering, vapor deposition, or the like can be employed.

3-2-2. Formation of Base Dielectric Layer 13

Next, in S22, base dielectric layer 13 is formed. As a material for base dielectric layer 13, there is used a base dielectric paste containing a base dielectric glass frit, a resin, a solvent and the like. First, by screen printing or the like, the base dielectric paste is applied with a predetermined thickness onto rear glass substrate 11 formed with address electrode 12, so as to coat address electrode 12. Next, the solvent in the base dielectric paste is removed by the baking oven. Finally, the base dielectric paste is baked by the baking oven at a predetermined temperature. That is, the resin in the base dielectric paste is removed. Further, the glass frit is melted. The base dielectric glass frit having been melted is re-vitrified after the baking. Base dielectric layer 13 is formed by the above process. Herein, other than the method for screen-printing the base dielectric layer paste, die coating, spin coating, or the like can be employed. Further, a film to be base dielectric layer 13 can be formed by CVD (Chemical Vapor Deposition) or the like without using the dielectric paste.

3-2-3. Formation of Barrier Ribs 14

Next, in S23, barrier ribs 14 are formed by photolithography. As a material for barrier rib 14, there is used a barrier rib paste containing a filler, a glass frit for binding the filler, a photosensitive resin, a solvent and the like. First, by die coating or the like, the barrier rib paste is applied with a predetermined thickness onto base dielectric layer 13. Next, the solvent in the barrier rib paste is removed by the baking oven. Subsequently, the barrier rib paste is exposed via a photomask with a predetermined pattern. Next, the barrier rib paste is developed, to form a barrier rib pattern. Finally, the barrier rib pattern is baked by the baking oven at a predetermined temperature. That is, the photosensitive resin in the barrier rib pattern is removed. Further, the glass frit in the barrier rib pattern is melted. Thereafter, by cooling to room temperature, the glass frit having been melted is re-vitrified. Barrier ribs 14 are formed by the above process. Herein, other than photolithography, sandblasting or the like can be employed.

3-2-4. Formation of Bonding Layer 20

Further, in S24, bonding layer 20 is formed onto barrier ribs 14. In the present embodiment, as an example, a bonding layer paste obtained by mixing the second glass member with a binder component is used.

First, a second glass member having an illustrated composition is ground by a wet jet mill or a ball mill such that an average grain size is from 0.5 μm to 3.0 μm, to produce a second glass member powder. Next, 50 wt % to 65 wt % of the second glass member powder is kneaded with 35 wt % to 50 wt % of the binder component by a triple roll, to manufacture a bonding layer paste for printing.

The binder component is terpineol or butyl carbitol acetate containing 1 wt % to 20 wt % of ethyl cellulose or an acrylate resin. Further, the bonding layer paste may be added with dioctyl phthalate, dibutyl phthalate, triphenyl phosphate or tributyl phosphate as a plasticizer. As a dispersant, glycerol monooleate, sorbitan sesquioleate, Homogenol (name of a product by Kao Corporation), phosphate ester of the alkyl and aryl group may add. The bonding layer paste with such a configuration improves printing properties.

As an example, a method for screen printing by use of the foregoing bonding layer paste will be shown. First, rear glass substrate 11 formed with barrier ribs 14 is installed on a screen printer. A screen is formed with a predetermined opening. That is, the opening is formed in line with the barrier rib pattern such that the bonding layer paste is printed on barrier ribs 14. Next, a predetermined amount of the bonding layer paste is dropped onto the screen. Subsequently, the bonding layer paste is applied and spread all over the screen. Finally, the screen is pressed onto rear glass substrate 11 by a squeegee or the like. The bonding layer paste is printed onto barrier ribs 14 by the above process. Thereafter, part of the binder component of the bonding layer paste is removed by the baking oven.

It is to be noted that a photosensitive paste, obtained by kneading the second glass member with the photosensitive resin or the like, can be used. Specifically, bonding layer 20 can also be formed by applying the photosensitive paste onto barrier ribs 14 and then exposing and developing the paste.

3-2-5. Formation of Phosphor Layers 15

Next, in S25, phosphor layers 15 are formed. As a material for phosphor layer 15, there is used a phosphor paste containing phosphor particles, a binder, a solvent and the like. First, by dispensing method or the like, the phosphor paste is applied with a predetermined thickness onto base dielectric layers 13 among plural adjacent barrier ribs 14 and to the side faces of barrier ribs 14. Next, the solvent in the phosphor paste is removed by the baking oven. Finally, the phosphor paste is baked by the baking oven at a predetermined temperature. That is, the resin in the phosphor paste is removed. Phosphor layers 15 are formed by the above process. Herein, other than the dispending method, screen printing or the like can be employed.

Rear plate 10 having a predetermined configuration is completed on rear glass substrate 11 by the above process.

3-3. Assembly of Front Plate 2 and Rear Plate 10

3-3-1. Sealing/Bonding Process

First, in S31, by dispensing method or the like, a sealing paste is applied to the peripheral edge of rear plate 10. The sealing paste contains the first glass member, a binder, a solvent and the like. The applied sealing paste forms a sealing paste layer (not shown). Next, the solvent in the sealing paste layer is removed by the baking oven. Thereafter, the sealing paste layer is pre-baked at a temperature of about 350° C. By the pre-baking, the resin component and the like in the sealing paste layer are removed. Next, front plate 2 and rear plate 10 are arranged as opposed to each other such that display electrodes 6 are orthogonal to address electrodes 12. Further, the peripheral edges of front plate 2 and rear plate 10 are held in the state of being pressed by a clip or the like.

Figure 5:
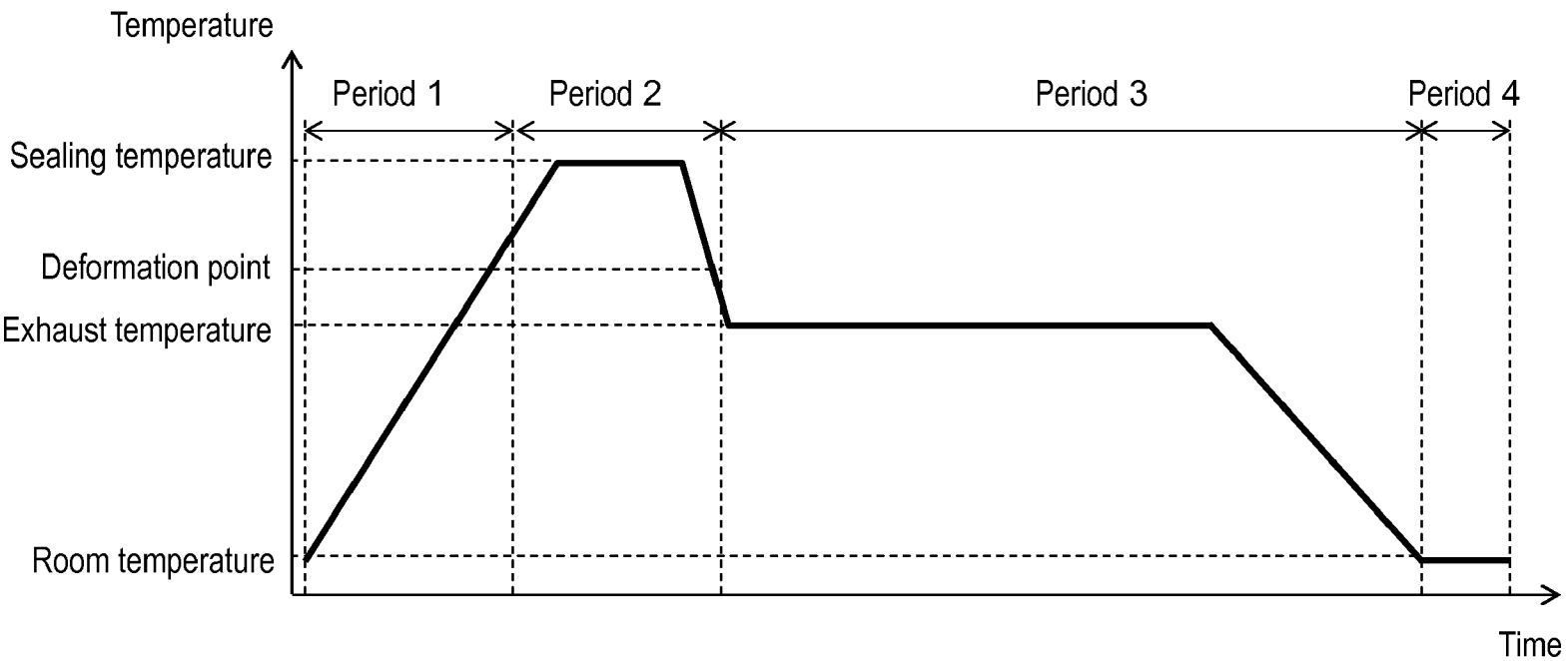
FIG. 5 is a diagram showing a temperature profile according to the embodiment.

The sealing, bonding, exhaust and introduction of the discharge gas are performed based on a temperature profile shown in FIG. 5.

The sealing temperature in FIG. 5 is a temperature at which front plate 2 and rear plate 10 are sealed by sealing member 22. Further, the sealing temperature is a temperature at which front plate 2 and at least part of barrier ribs 14 are bonded by bonding layer 20. The sealing temperature in the present embodiment is, for example, about 490° C. Further, the exhaust temperature in FIG. 5 is a temperature at the time of exhausting gas from discharge space 16. The exhaust temperature in the present embodiment is, for example, about 400° C. Further, the deformation point in FIG. 5 is the deformation point of the second glass member. The deformation point in the present embodiment is, for example, 440° C.

First, in period 1 shown in FIG. 5, the temperature rises from room temperature to the softening point (e.g. 470° C.) of the first glass member. Next, in period 2, the temperature rises from the softening point of the first glass member to the sealing temperature (e.g. 490° C.). The sealing temperature is above the deformation point of the second glass member and below the softening point of the second glass member. In period 2, the temperature is held for certain time period. By thermal treatment in period 2, front plate 2 and rear plate 10 are sealed by sealing member 22. Further, front plate 2 and at least part of barrier ribs 14 are bonded to each other by bonding layer 20. In the present embodiment, at least part of first barrier ribs 24 and protective layer 9 are bonded to each other by bonding layer 20. Thereafter, the temperature falls below the deformation point of the second glass member.

3-3-2. Exhaust Process

Next, in S32, gas is exhausted from discharge space 16. In period 3 shown in FIG. 5, the temperature falls to the exhaust temperature, and held thereat for a certain time period. In period 3, gas is exhausted from the inside of discharge space. That is, after the thermal treatment in period 2, gas is preferably exhausted from discharge space 16 at a temperature lower than the deformation point of the second glass member, because it can suppress transformation of bonding layer 20.

3-3-3. Discharge Gas Introduction Process

Next, in S33, discharge gas is introduced into discharge space 16. In period 4 shown in FIG. 5, the temperature falls to the order of room temperature. After the temperature has fallen to the order of room temperature, the discharge gas is introduced.

PDP 1 is completed by the above process.

It should be noted that as described above, in S31, the peripheral edges of front plate 2 and rear plate 10 are held in the state of being pressed by a clip or the like. Further, in the thermal treatment at the time of sealing and bonding, it is preferable to uniformly apply pressure all over front plate 2 and rear plate 10, allowing stable bonding. As a method for applying pressure, there is a method for sandwiching front plate 2 and rear plate 10 with a predetermined pressure by use of a presser or the like. Moreover, reducing pressure between the front plate 2 and rear plate 10 causes application of differential pressure between atmospheric pressure (one atmospheric pressure) and internal pressure to front plate 2 and rear plate 10. That is, it is possible to uniformly apply pressure all over front plate 2 and rear plate 10.

4. Conclusion

PDP 1 according to the present embodiment includes: front plate 2; rear plate 10 having barrier ribs 14; sealing member 22 that seals a peripheral edge of front plate 2 and a peripheral edge of rear plate 10; and bonding layer 20 that bonds at least part of barrier ribs 14 and front plate 2 to each other. Sealing member 22 has a first glass member. Bonding layer 20 has a second glass member. A deformation point of the second glass member is lower than a softening point of the first glass member. A softening point of the second glass member is higher than the softening point of the first glass member.

According to this configuration, it is possible to set the sealing temperature to a range higher than the softening point of the first glass member and lower than the softening point of the second glass member. Meanwhile, when the sealing temperature is set to not lower than the softening point of the second glass member, the second glass member may flow into discharge space 16. Further, an amount of gas discharged from the second glass member may increase. In these cases, problems such as a rise in discharge voltage and deterioration in luminance may occur. In PDP 1 in the present embodiment can realize stable bonding, while suppressing the foregoing problems. That is, a decrease in mechanical strength of PDP 1 can be suppressed.

A method for manufacturing PDP 1 according to the present embodiment is a method for manufacturing PDP 1 which includes: front plate 2; rear plate 10 having barrier ribs 14; sealing member 22 that seals a peripheral edge of front plate 2 and a peripheral edge of rear plate 10; and bonding layer 20 that bonds at least part of barrier ribs 14 and front plate 2 to each other. Sealing member 22 has a first glass member, and bonding layer 20 has a second glass member having a deformation point lower than a softening point of the first glass member, and a softening point higher than the softening point of the first glass member. Thermal treatment is performed at a temperature higher than the softening point of the first glass member and lower than the softening point of the second glass member, to seal front plate 2 and rear plate 10, and at least part of barrier ribs 14 and front plate 2 are bonded to each other.

According to this method, it is possible to perform stable sealing and bonding, while suppressing flowing of the second glass member into discharge space 16 at the time of thermal treatment. It is therefore possible to manufacture PDP 1 where a decrease in mechanical strength is suppressed.

5. Other Embodiments

Figure 6:
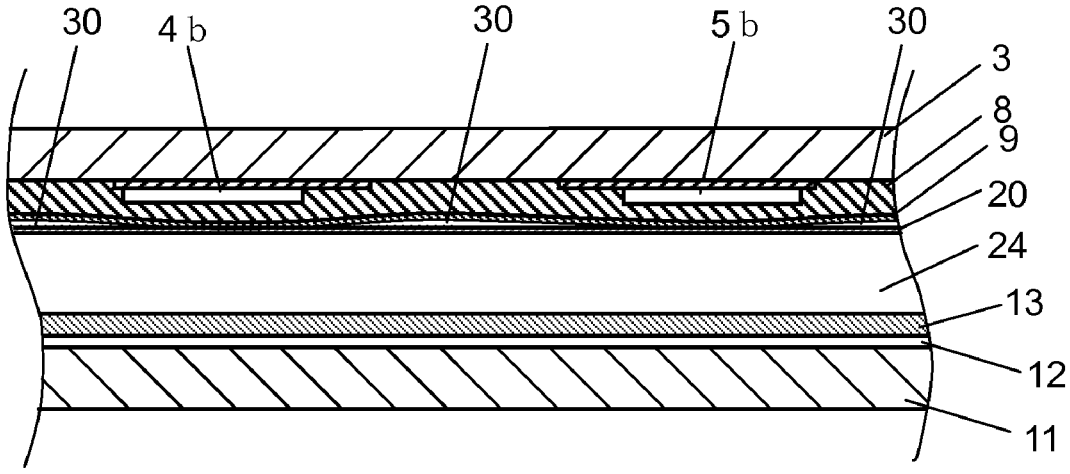
FIG. 6 is a view showing part of a cross section of a PDP according to another embodiment.

As thus described, PDP 1 according to the present embodiment has been illustrated. However, the present invention is not restricted to this embodiment. FIG. 6 shows PDP 1 according to another embodiment. It is to be noted that in FIG. 6, the same configurations as those shown in FIGS. 1 to 3 are provided with the same numerals. As for the configurations with the same numerals, descriptions thereof will be omitted as appropriate. Further, FIG. 6 shows part of a cross section orthogonal to the cross section A-A in FIG. 2. As shown in FIG. 6, front plate 2 has dielectric layer 8 that coats display electrodes 6, and display electrodes 6 include plural bus electrodes 4*b*, 5*b* arranged in parallel. Bonding layer 20 bonds first barrier ribs 24 with regions in front plate 2 where plural bus electrodes 4*b*, 5*b* are opposed to first barrier rib 24. Voids 30 are formed in regions between plural bus electrodes 4*b*, 5*b* in front plate 2 where they are opposed to first barrier ribs 24.

According to this configuration, a void 30 comes to serve as an exhaust channel at the time of gas exhaust, thereby facilitating gas exhaust from the inside of discharge space 16. It is therefore possible to more easily manufacture PDP 1, while suppressing a decrease in mechanical strength.

Film thicknesses of bus electrodes 4*b*, 5*b* shown in FIG. 6 are, for example, 4 μm to 6 μm. Further, for the purpose of reducing reactive power at the time of discharge, when dielectric layer 8 with a low dielectric constant is formed, a film thickness of dielectric layer 8 is made small so as to hold a capacity at the same level as a capacity at the time of formation of dielectric layer 8 with a high dielectric constant. As an example, in the case of dielectric layer 8 with a dielectric constant of 5 to 7, its film thickness is preferably from not smaller than 10 μm and not larger than 20 μm. Conventionally, in dielectric layer 8 with a dielectric constant of the order of 11, its film thickness has been about 40 μm. When the film thickness of dielectric layer 8 becomes smaller, the dielectric layer 8 swells in the bus electrodes 4*b*, 5*b* portions, as shown in FIG. 6, to form unevenness. When PDP 1 is formed of front plate 2 formed with the unevenness and rear plate 10, voids 30 can be formed in the regions plural bus electrodes 4*b*, 5*b* in front plate 2 where they are opposed to first barrier rib 24. At this time, the thickness of bonding layer 20 before bonding is preferably not smaller than a half of the film thicknesses of bus electrodes 4*b*, 5*b*, and not larger than three-seconds of the same. When the thickness is smaller than a half, the region to be bonded becomes small, to cause a decrease in mechanical strength. When the thickness exceeds three-seconds, voids 30 are filled with bonding layer 20, making it difficult to form the exhaust channel.

It should be noted that bonding layer 20 may be configured such that not only first barrier ribs 24 and front plate 2 are bonded to each other, but also second barrier ribs 26 and front plate 2 are bonded to each other.

As thus described, the technique disclosed in the present embodiment is useful in realizing a PDP having a reduced weight and increased definition, while suppressing a decrease in mechanical strength.

The invention claimed is:

1. A plasma display panel, comprising:

a front plate including a plurality of display electrodes, a first dielectric layer covering the plurality of display electrodes, and a protective layer covering the first dielectric layer;

a rear plate including a plurality of address electrodes, a second dielectric layer covering the plurality of address electrodes, and barrier ribs disposed on the second dielectric layer, the barrier ribs including a first barrier rib arranged in a direction intersecting the plurality of display electrodes and a second barrier rib orthogonal to the first barrier rib;

a sealing member configured to seal a peripheral edge of the front plate and a peripheral edge of the rear plate together; and a bonding layer disposed on the barrier ribs so that at least a portion of the bonding layer directly contacts the protective layer, and being configured to bond at least part of the barrier ribs and the front plate to each other, wherein the sealing member has a first glass member, the bonding layer has a second glass member, and a deformation point of the second glass member is lower than a softening point of the first glass member, and a softening point of the second glass member is higher than the softening point of the first glass member where in the second glass member includes $Bi_2O_3$ and $B_2O_3$, and a molar ratio of $Bi_2O_3$ to $B_2O_3$ in the second glass member is not less than 0.25:1 and not more than 4:1.

2. The plasma display panel according to claim 1, wherein the bonding layer is disposed on the first barrier rib and is configured to bond at least part of the first barrier ribs and the front plate to each other.

3. The plasma display panel according to claim 1, wherein the second glass member contains $Bi_2O_3$ not less than 10 mol % and not more than 40 mol %, and $B_2O_3$ not less than 10 mol % and not more than 40 mol %.

4. The plasma display panel according to claim 1, wherein the bonding layer is disposed only on the first barrier ribs.

5. The plasma display panel according to claim 1, wherein the bonding layer does not substantially cover the second barrier ribs.

6. The plasma display panel according to claim 2, wherein the display electrodes include a plurality of bus electrodes arranged in parallel, the bonding layer bonds the first barrier ribs to the front panel at regions where the plurality of bus electrodes are opposed to the first barrier ribs, and voids are disposed between the front panel and the first barrier ribs at regions where places between the plurality of bus electrodes are opposed to the first barrier ribs.

* * * * *